United States Patent [19]

Ohminato

[11] Patent Number: 4,815,882

[45] Date of Patent: Mar. 28, 1989

[54] TURNTABLE TYPE BINDER ASSEMBLIES

[75] Inventor: Kiyoshi Ohminato, Tokyo, Japan

[73] Assignee: King Jim Co., Ltd., Tokyo, Japan

[21] Appl. No.: 133,210

[22] Filed: Dec. 14, 1987

Related U.S. Application Data

[63] Continuation of Ser. No. 839,152, Mar. 13, 1986, abandoned.

[30] Foreign Application Priority Data

Jan. 8, 1986 [JP] Japan ..... 61-000926[U]

[51] Int. Cl.[4] ..... B42F 13/20; B42F 3/02; B42F 13/02; B42F 3/04

[52] U.S. Cl. ..... 402/34; 402/20; 402/30; 402/31

[58] Field of Search ..... 402/32, 33, 35, 37, 402/19, 28, 48, 20, 30, 31, 34; 411/340, 341, 344, 346; 24/67 PR, 67.9

[56] References Cited

U.S. PATENT DOCUMENTS

| | | | |
|---|---|---|---|
| 692,584 | 2/1902 | Adams et al. | 402/20 |
| 904,618 | 11/1908 | Kellner, Jr. | 402/20 |
| 1,331,226 | 2/1920 | Adams | 402/20 |
| 1,402,018 | 1/1922 | Schade | 402/20 |
| 1,473,354 | 11/1923 | Nachtrieb | 402/20 |
| 1,797,447 | 3/1931 | Savidge | 402/34 |
| 2,077,677 | 4/1937 | Dawson et al. | 402/34 |
| 2,311,620 | 2/1943 | Murphy | 402/30 |
| 3,104,667 | 9/1963 | Mintz | 402/35 |
| 4,624,595 | 11/1986 | Ohminato | 402/31 |

FOREIGN PATENT DOCUMENTS

| | | | |
|---|---|---|---|
| 630676 | 3/1936 | Fed. Rep. of Germany | 402/30 |
| 2540340 | 7/1977 | Fed. Rep. of Germany | 402/31 |
| 2411715 | 7/1979 | France | 402/34 |

*Primary Examiner*—Frank T. Yost
*Assistant Examiner*—Paul M. Heyranasr
*Attorney, Agent, or Firm*—Wegner & Bretschneider

[57] ABSTRACT

A turnable type binder assembly including a fixed base plate provided with a fixed binding rod and a turnable base plate provided with a turnable binding rod, said turnable plate being turnable with respect to said fixed plate, wherein said turnable plate is slightly movable along the axis, around which it is turnable, under the action of a spring.

2 Claims, 2 Drawing Sheets

TURNTABLE TYPE BINDER ASSEMBLIES

This application is a continuation of application Ser. No. 839,152, filed Mar. 13, 1986, now abandoned.

FIELD OF THE INVENTION

The present invention relates to improvements in turnable type binder assemblies.

BACKGROUND OF THE INVENTION

The prior art binder having enjoyed wide use includes a single base plate provided thereon with a fixed binding rod and an associated binding rod that is turnable so as to keep papers on file with the fixed rod. That binder is opened or closed by turning the turnable binding rod. However, engagement or disengagement of plural pairs of the fixed rods with or from turnable rods is troublesome and poses a handling problem.

SUMMARY OF THE INVENTION

In view of the foregoing, the present invention has been accomplished, and has for its object to provide a turnable type binder assembly including a fixed base plate provided with a fixed binding rod and a turnable base plate provided with a turnable binding rod, said turnable plate being turnable with respect to said fixed plate, wherein said turnable plate is slightly movable along the axis, around which it is turnable, under the action of a spring.

According to the arrangement of the present invention, even though there is provided plural pairs of fixed binding rods and turnable binding rods, their engagement at the free ends can at once be removed.

BRIEF DESCRIPTION OF THE DRAWINGS

The foregoing and other objects and features of the present invention will now become apparent from the following detailed description with reference to the accompanying drawings, which are given for the purpose of illustation alone, and in which.

PREFERRED EMBODIMENTS OF THE INVENTION

Figure 1:
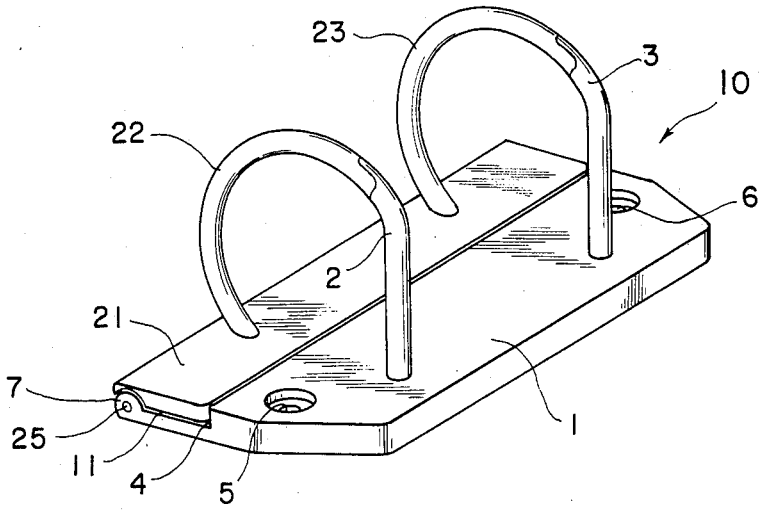
FIG. 1 is a perspective view showing one emboidment of the turnable type binder according to the present invention.

Referring now to FIG. 1, reference numeral 1 stands for a fixed base plate on which first binding rods 2 and 3 having cavity type engaging means 27 are each vertically provided in an integral manner. The base plate 1 is stepped at 4 to define a portion 11 on which a turnable plate is to be mounted. A turnable plate 21 having second binding rods 22 and 23 having button type engaging means 28 in an integral manner is turnably mounted. Turnable plate 21 is turnable between an open position in which first binding rods 2 and 3 are separate from second binding rods 22 and 23, and a closed position in which first binding rods 2 and 3 cooperatively engage second binding rods 22 and 23. Reference numerals 5 and 6 indicate mounting holes. A first engaging means 27 is provided on first binding rods 2 and 3. A second engaging means 28 is provided on second binding rods 22 and 23. First engaging means 27 and second engaging means 28 cooperatively engage each other when turnable plate 21 is in the closed position.

Figure 2:
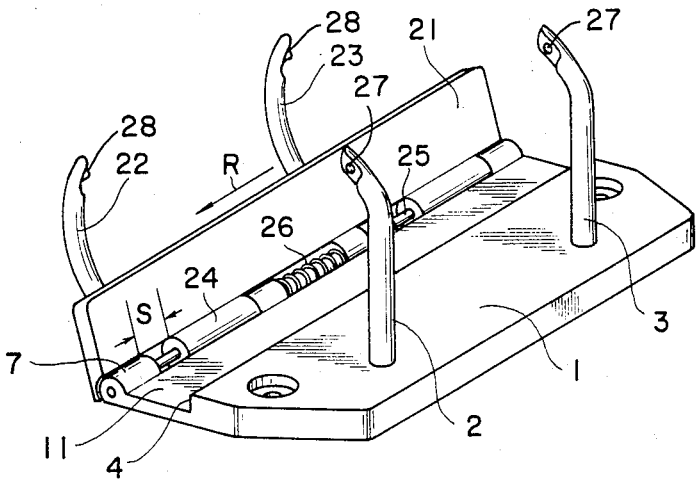
FIG. 2 is a view illustrating the junction or connection between a fixed plate and a turnable plate.
Figure 3:
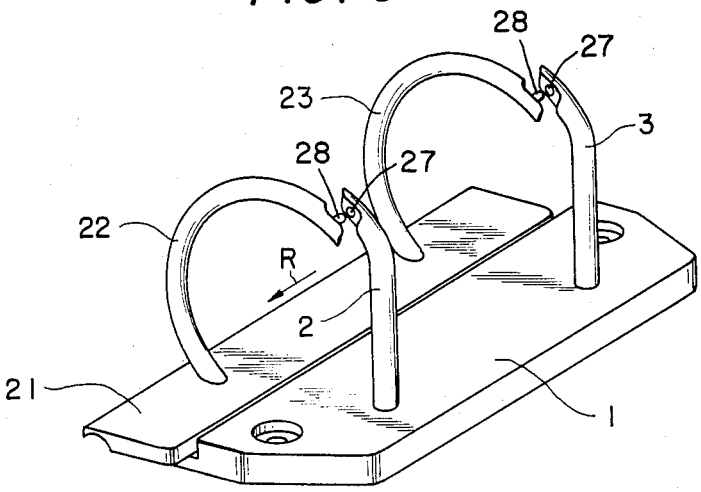
FIG. 3 is a view illustrating the turnable plate which is slid slightly.

FIG. 2 illustrates the turnable base plate which is opened so as to clearly show the mounting of the plate 1 with the plate 21. The portion 11 of the plate 1 is provided on the edge with a hollow portion 7 in the cylindrical form, and the plate 21 is provided on the edge with a hollow portion 24 in the cylidrical form. Between the hollow portions 7 and 24 there is inserted a core rod material 25. A spring 26 is positioned in the middle in such a manner that, as illustrated in FIG. 3, the turnable plate 21 can slidingly be moved in the lefthand direction (in the direction indicated by an arrow R in the figure) by a space S defined between the hollow portions, while keeping the second binding rods 22 and 23 with fingers, and release of the fingers causes the turnable plate to return to the original position under the action of the spring 26. It is noted that the spring 26 is designed to bias the plate 26 in the righthand direction (i.e., in the direction opposite to that indicated by R).

Figure 4:
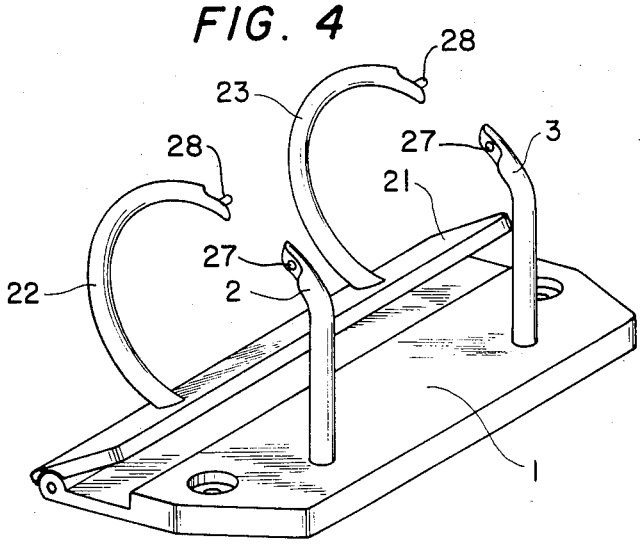
FIG. 4 is a view illustrating the turnable plate which is opened.

FIG. 3 illustrates the turnable binding rods 22 and 23 disengaged from the first binding rods 2 and 3 by moving the turnable plate 21 in the direction of R in FIG. 2 against the action of the spring 26. FIG. 4 also shows the turnable plate 21 which is further turned, followed by release of the fingers, whereby the plate 21 is restored to the original position under the action of the spring 26.

The binder according to the present invention is closed, as shown in FIG. 1 by removing or fitting papers from or to the fixed rods 2 and 3 in a state where the binder is opened, as shown in FIG. 4, and then turning the plate 21 to bring the free ends of the second binding rods 22 and 23 close to the fixed rods for engagement.

Since the turnable base plate can slidingly be moved according to the particular embodiment of the present invention, even though there are provided plural pairs of fixed binding rods and turnable binding rods, the free ends of one can at once be disengaged from those of the other, thus assuring easy and convenient handling.

Although the present invention has been described in its preferred form with a certain degree of particularity, it is understood that the present disclosure of the preferred form has been made only by way of example and that some changes or modifications may be made without departing from the scope of the present invention.

What is claimed is:

1. A turnable type binder assembly comprising:

a base plate, at least one first binding rod fixed to said base plate and having a cavity type first engaging means, a turnable plate rotatably mounted to said base plate about an axis with respect to said base plate, and turnable between an open position and a closed position, at least one second binding rod fixed to said turnable plate and having a button type second engaging means, and a spring located along said axis for biasing said second engaging means into cooperative abutment with said first engaging means when said turnable plate is in said closed position, whereby said at least one second binding rod is disengaged from said at least one first binding rod by moving said turnable plate together with said second binding rod in a direction along said axis against the biasing force of said spring.

2. A binder assembly as defined in claim 1 wherein when said turnable plate is in said closed position, said turnable plate abuts said base plate to form a substantially flat surface along the abutting base plate and turnable plate.

* * * * *